US009017132B2

(12) United States Patent
Lin

(10) Patent No.: US 9,017,132 B2
(45) **Date of Patent: *Apr. 28, 2015**

(54) SIMPLIFIED MODULARIZED CONTACT TYPE OF CONDUCTIVE BUILDING BLOCK

(71) Applicant: Chia-Yen Lin, Dongguan (CN)

(72) Inventor: Chia-Yen Lin, Dongguan (CN)

( * ) Notice: Subject to any disclaimer, the term of this patent is extended or adjusted under 35 U.S.C. 154(b) by 0 days.

This patent is subject to a terminal disclaimer.

(21) Appl. No.: 14/082,226

(22) Filed: Nov. 18, 2013

(65) Prior Publication Data

US 2015/0072585 A1 Mar. 12, 2015

Related U.S. Application Data

(63) Continuation-in-part of application No. 14/023,767, filed on Sep. 11, 2013, now Pat. No. 8,651,913.

(51) Int. Cl.
*A63H 33/04* (2006.01)

(52) U.S. Cl.
CPC ..... *A63H 33/042* (2013.01)

(58) Field of Classification Search
USPC ..... 446/85, 91, 118, 124, 477, 484
See application file for complete search history.

(56) References Cited

U.S. PATENT DOCUMENTS

| | | | | | |
|---|---|---|---|---|---|
| 3,696,548 | A * | 10/1972 | Teller | 446/91 |
| 4,743,202 | A * | 5/1988 | Bach | 439/53 |
| 4,883,440 | A * | 11/1989 | Bolli | 446/91 |
| 5,848,503 | A * | 12/1998 | Toft et al. | 52/173.1 |
| 6,062,937 | A * | 5/2000 | Kikuchi | 446/91 |
| 6,443,796 | B1 * | 9/2002 | Shackelford | 446/91 |
| 6,585,553 | B1 * | 7/2003 | Fetridge et al. | 446/91 |
| 6,805,605 | B2 * | 10/2004 | Reining et al. | 446/91 |
| 6,939,192 | B1 * | 9/2005 | Munch et al. | 446/91 |
| 7,846,002 | B1 * | 12/2010 | Mikesell et al. | 446/91 |
| 8,079,890 | B2 * | 12/2011 | Seligman | 446/124 |
| 2008/0166926 | A1 * | 7/2008 | Seymour et al. | 439/701 |

* cited by examiner

*Primary Examiner* — Kurt Fernstrom
(74) *Attorney, Agent, or Firm* — Lin & Associates IP, Inc.

(57) ABSTRACT

A simplified modularized contact type of conductive building block includes: a brick, at least one pair of conductive pieces, a circuit board and a base. The brick includes at least one pair of studs projected from a top thereof. The conductive piece has an insertion electrode and a connection electrode respectively disposed at two ends thereof and a contact electrode disposed between the insertion electrode and the connection electrode. The conductive pieces are inserted through the insertion through holes of the circuit board. The circuit board includes a positive electrode circuit and a negative electrode circuit respectively contacted with the at least one pair of the conductive pieces. The conductive pieces are further inserted through the through holes of the base. The circuit board and the base are fixed in the brick.

9 Claims, 19 Drawing Sheets

SIMPLIFIED MODULARIZED CONTACT TYPE OF CONDUCTIVE BUILDING BLOCK

CROSS-REFERENCE TO RELATED APPLICATION

This application is a continuation-in-part of U.S. patent application Ser. No. 14/023,767, filed on Sep. 11, 2013, which is incorporated herewith by reference.

BACKGROUND OF THE INVENTION

1. Field of the Invention

The present invention relates generally to a building block, and in particular to a simplified modularized contact type of conductive building block.

2. the Prior Arts

New types of toys that can boost intelligence, such as building blocks, are developed with the advance of the electronic industry. For example, the conventional building block further includes a circuit board, LED lights, speakers, etc. disposed therein. After a plurality of building blocks are connected with each other, the building blocks would emit light or play music, which provides more entertainment and fun.

A conventional electric connection building blocks, such as Taiwan Utility Model Patent No. M408402, include fixation posts mounted on a circuit board. The fixation post includes a positive conducting unit and a negative conducting unit. Each of the positive and negative conducting units has a metal lead. The metal leads are soldered on the circuit board and connected with the electronic components by the circuit board.

However, the positive and negative electrodes are simultaneously assembled to the fixation post of the conventional light emitting building block. Thus, the fixation post has a lot of components and a complex structure. Moreover, it needs to solder the positive and negative conducting units on the circuit board, but the soldering process is not only expensive but also not environmental friendly.

Furthermore, both of the positive electrode and the negative electrode are assembled in the same stud hole. If any metal foreign matter is fallen into the stud or the stud is compressed and deformed, it is likely that both of electrodes are contacted with each other to form the electric connection. Short circuit would occur.

SUMMARY OF THE INVENTION

To overcome the disadvantages of conventional designs which has a lot of components, a complex structure, a need for a soldering process and a risk of short circuit, a primary objective of the present invention is to provide a simplified modularized contact type of conductive building block, which has few components, a simple structure and improved safety and is soldering free.

In order to achieve the objective, a simplified modularized contact type of conductive building block according to the present invention includes: a brick, at least one pair of conductive pieces, a circuit board and a base.

The brick has a hollow structure and includes at least one pair of studs projected from a top thereof and an opening defined in a bottom thereof and communicating with an interior thereof. Each stud has a stud hole penetrating therethrough and communicating with the interior of the brick.

The at least one pair of conductive pieces are inserted through the stud holes, respectively. Each of the conductive pieces includes an insertion electrode located at a top of the conductive piece, a connection electrode located at a bottom of the conductive piece and a contact electrode located between the insertion electrode and the connection electrode. The contact electrode is located close to the connection electrode and horizontally extended from the conductive piece.

The circuit board is disposed in the interior of the brick. The circuit board includes at least one pair of insertion through holes corresponding to the at least one pair of conductive pieces and the conductive pieces are respectively inserted through the insertion through holes of the circuit board. The circuit board has a positive electrode circuit and a negative electrode circuit. The positive electrode circuit is contacted with the contact electrode of a first conductive piece of each pair of conductive pieces, and the first conductive piece is a positive electrode. The negative electrode circuit is contacted with the contact electrode of a second conductive piece of each pair of conductive pieces, and the second conductive piece is a negative electrode.

The base is disposed in the interior of the brick. The base includes at least one pair of through holes corresponding to the at least one pair of conductive pieces and the conductive pieces are respectively inserted through the through holes of the base.

Preferably, the brick includes two pairs of studs and the studs are symmetrically arranged in a matrix.

Each pair of conductive pieces include a first conductive piece and a second conductive piece. Preferably, the second conductive piece is adjacent to the first conductive piece. More preferably, the brick includes two pairs of conductive pieces and the conductive pieces are symmetrically arranged in a matrix and located corresponding to the studs. The tops of the insertion electrodes of the conductive pieces are received in the stud holes, respectively.

The at least one pair of insertion through holes of the circuit board has a shape and size corresponding to those of the bottom of the conductive pieces. Thus, the bottoms of the at least one pair of the conductive pieces may be inserted through the insertion through holes of the circuit board, respectively. Preferably, the circuit board includes two pairs of insertion through holes, the insertion through holes are symmetrically arranged in a matrix and the insertion through holes are located corresponding to the conductive pieces.

The at least one pair of through holes of the base has a shape and size corresponding to those of the bottom of the conductive pieces. Thus, the bottoms of the at least one pair of the conductive pieces may be inserted through the through holes of the base, respectively. Preferably, the base includes two pairs of through holes, the through holes are symmetrically arranged in a matrix and the through holes are located corresponding to the conductive pieces.

Preferably, the connection electrode of the conductive piece includes two end portions and a gap located between the two end portions. The insertion electrode of the conductive piece is corresponding to the gap.

Preferably, the gap of the connection electrode has a size corresponding to that of the insertion electrode.

Preferably, the gap close to the bottom of the connection electrode of the conductive piece has a size smaller than that of the insertion electrode. Thus, the insertion electrode can be inserted into the gap by applying a force.

Preferably, the insertion electrode is aligned with the connection electrode. A top end of the insertion electrode is recessed to form a curved cavity and a bottom end of the connection electrode is protruded to form a curved protrusion corresponding to the curved cavity.

Preferably, a retaining portion of the conductive piece is disposed between the insertion electrode and the connection electrode, located adjacent to the insertion electrode, and horizontally extended from the conductive piece to be pressed against a bottom edge of the stud.

Preferably, the contact electrode of the conductive piece is parallel to the retaining portion of the conductive piece and perpendicular to the conductive piece.

Preferably, the bottom edge of the stud is extended inward to form a retaining ridge and the insertion electrode of the conductive piece is inserted through the retaining ridge.

Preferably, the retaining portion of the conductive piece is disposed between the insertion electrode and the connection electrode and is horizontally extended from the conductive piece to be pressed against the retaining ridge of the stud.

The simplified modularized contact type of conductive building block according to the present invention provides the conductive pieces having simple structures. Therefore, it is easy to assemble the conductive pieces to the circuit board. When assembling the building block, the conductive pieces are pressed against the brick, the contact electrodes of the conductive pieces are pressed against the circuit board, the conductive pieces are inserted through the insertion through holes of the circuit board and the through holes of the base, and the base is pressed against the circuit board and fixed in the brick. Therefore, the conductive pieces are securely pressed against and contacted with the circuit board and it does not need to electrically connect the conductive piece with the circuit board by the soldering process. Thus, the building block according to the present invention has the advantage of being environmental friendly, labor saving and cost saving.

Furthermore, the positive and the negative electrodes of the conductive piece are decided by the contact electrode of the conductive piece being contacted with the positive electrode circuit or the negative electrode circuit of the circuit board. Therefore, after the building block is assembled, the conductive pieces can be clearly classified as the positive electrode conductive piece or the negative electrode conductive piece. Moreover, each stud hole has only one electrode disposed therein. Therefore, even the metal foreign matter is fallen into the stud hole or the stud being compressed and deformed, it does not cause the short circuit. Therefore, the safety of the building blocks is secured.

BRIEF DESCRIPTION OF THE DRAWINGS

The present invention will be apparent to those skilled in the art by reading the following detailed description of preferred embodiments thereof, with reference to the attached drawings, in which.

DETAILED DESCRIPTION OF THE PREFERRED EMBODIMENT

Figure 1:
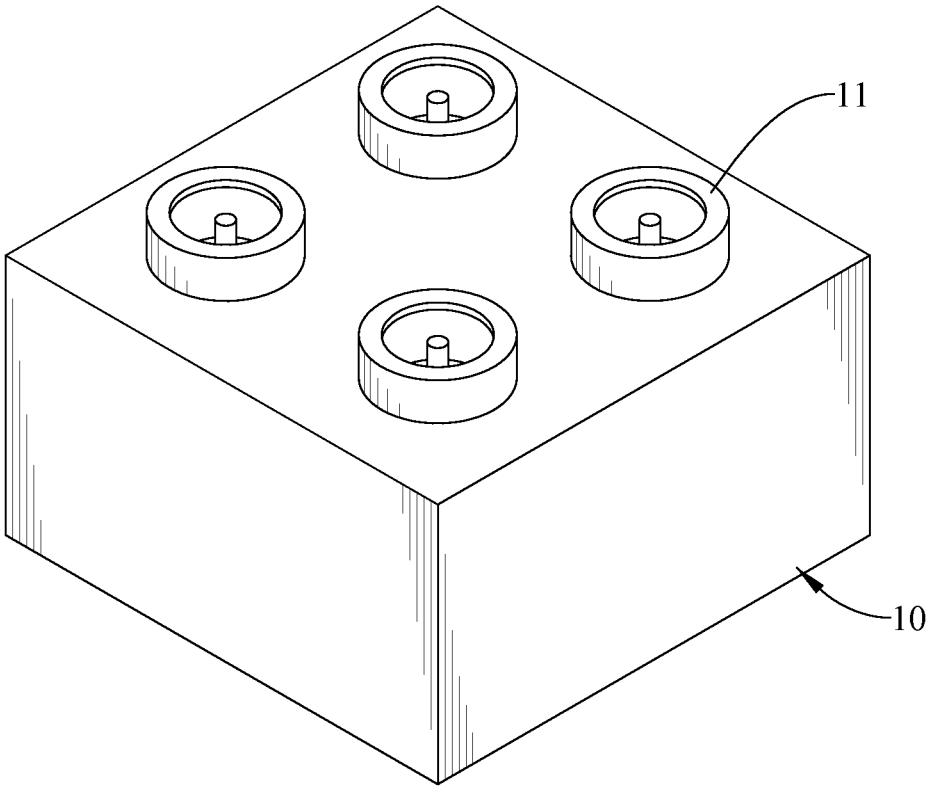
FIG. 1 is a perspective view showing a simplified modularized contact type of conductive building block according to a first embodiment of the present invention.
Figure 2:
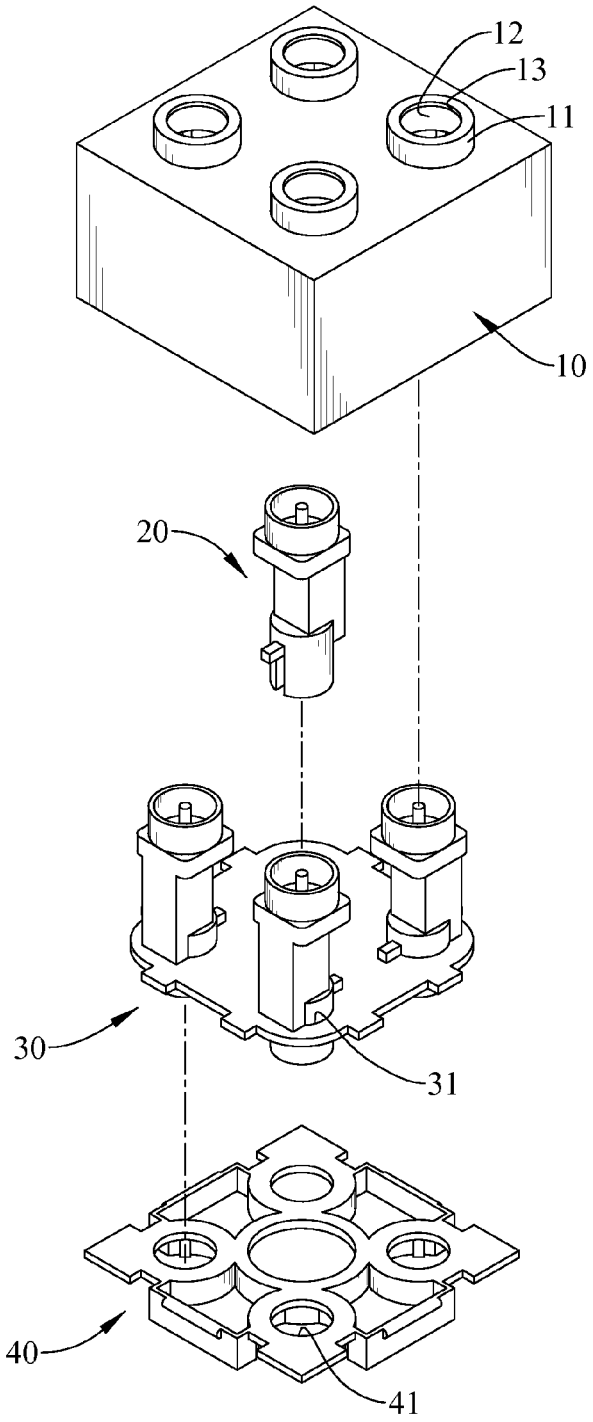
FIG. 2 is an exploded view showing the simplified modularized contact type of conductive building block according to the first embodiment of the present invention.

With reference to FIGS. 1 and 2, a simplified modularized contact type of conductive building block according to a first preferred embodiment of the present invention includes a brick 10, at least one pair of fixation posts 20, a circuit board 30, and a base 40. The brick 10 is a light-transmittable hollow cube. The brick 10 includes at least one pair of ring-shaped studs 11 projected from a top thereof. A stud hole 12 penetrates through the stud 11 and communicates with an interior of the brick 10. A top edge of an inner wall of the stud hole 12 extends inward to form a ring-shaped retaining ridge 13. An opening is defined in a bottom of the brick 10 and communicates with the interior of the brick 10. Preferably, the top of the brick 10 is projected to form two pairs of studs which are symmetrically arranged in a matrix.

Figure 3:
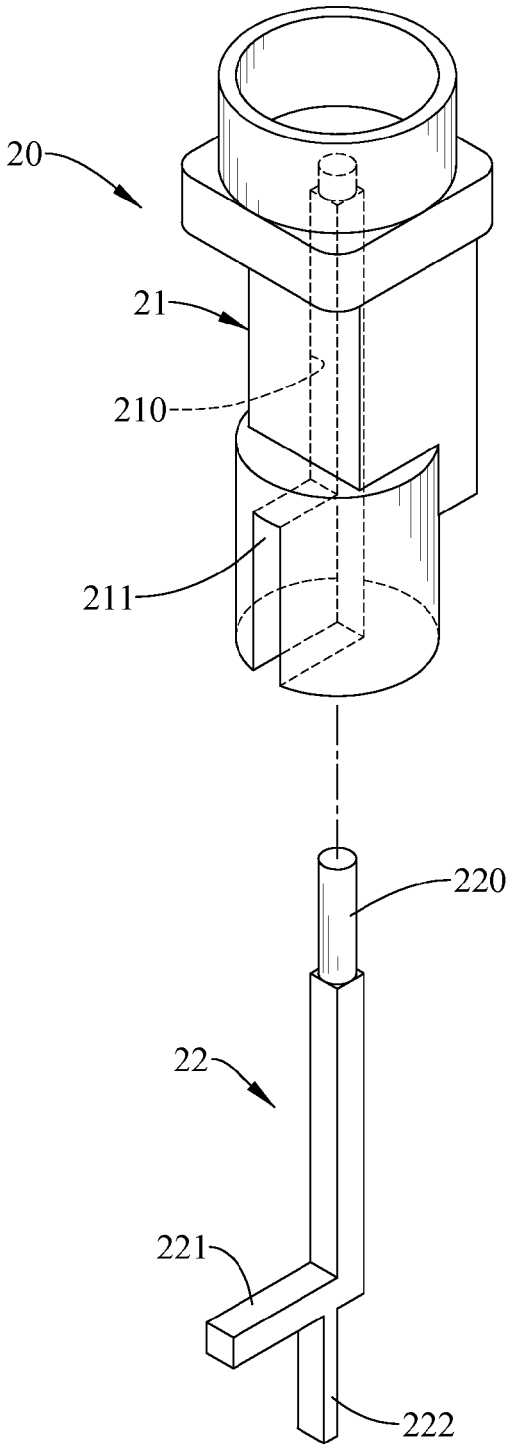
FIG. 3 is an exploded view showing a fixation post according to the first embodiment of the present invention.
Figure 6:
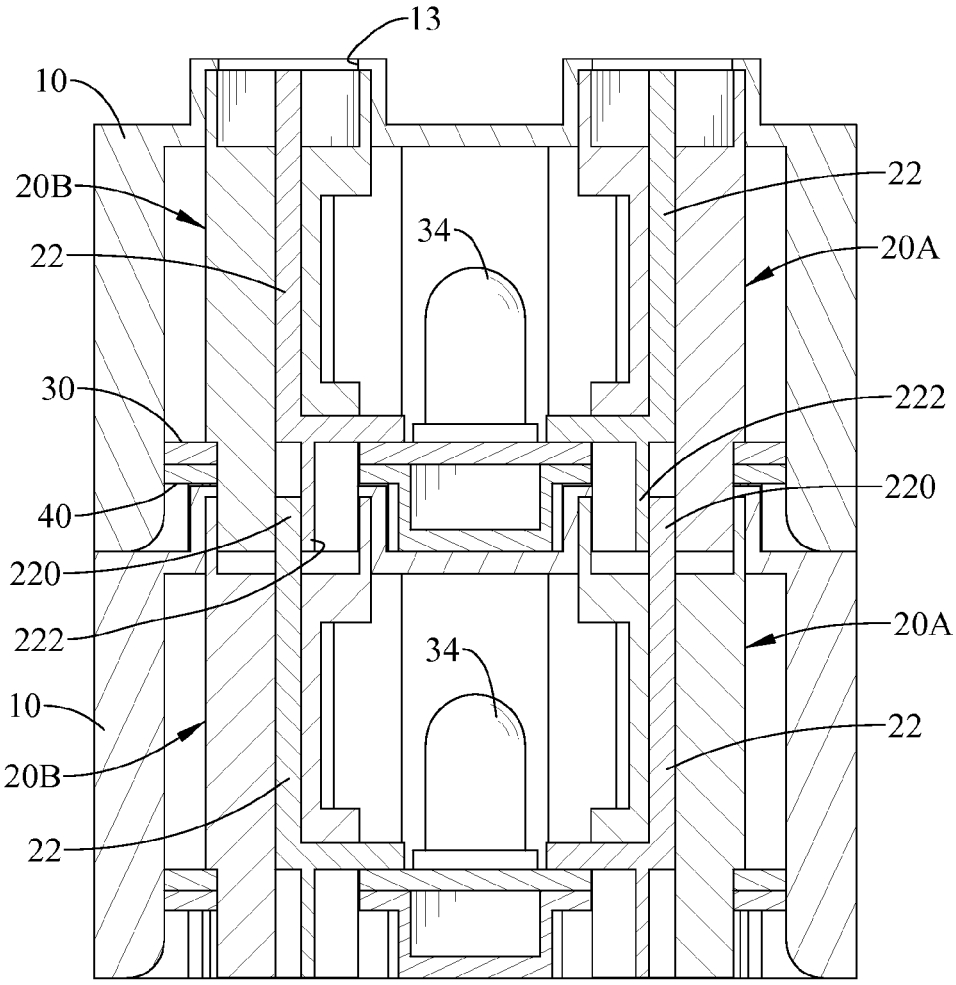
FIG. 6 is a cross-sectional view showing two of the simplified modularized contact type of conductive building blocks according to the first embodiment of the present invention connected with each other.

The at least one pair of fixation posts 20 are disposed in the stud holes 12 of the stud 11 of the brick 10 and tops of the fixation posts 20 are pressed against the ring-shaped retaining ridges 13 (as shown in FIG. 6), respectively. According to the first embodiment, the brick 10 has two pairs of fixation posts 20 symmetrically arranged in a matrix. Referring to FIG. 3, each fixation post 20 includes an insulating piece 21 and a conductive piece 22. A top of the insulating piece 21 is located in the stud hole 12. The insulating piece 21 includes an assembling hole 210 vertically penetrating through an interior thereof and an extension groove 211 formed at a side of a bottom thereof. The extension groove 211 communicates with the assembling hole 210. The insulating piece 21 according to the first embodiment is only a type of the present invention. According to another type, the insulating piece 21 may have two half pieces face-to-face joining together. According to still another type, the insulating piece 21 may also have upper and lower tubes connected with each other in an insertion way. Moreover, the top and the bottom of the insulating piece 21 of the fixation post 20 may be shaped in a circle or a rectangle. The types and the shapes of the fixation posts 20 according to the present invention are not limited.

The conductive piece 22 is disposed in the assembling hole 210 of the insulating piece 21. An insertion electrode 220 is located at a top of the conductive piece 22 and projected out of the assembling hole 210. A contact electrode 221 is horizontally extended from a side of a bottom of the conductive piece 22. The contact electrode 221 penetrates through and projects out of the extension groove 211. A connection electrode 222 is vertically extended from the bottom of the conductive piece 22 and misaligned with the insertion electrode 220.

Figure 4:
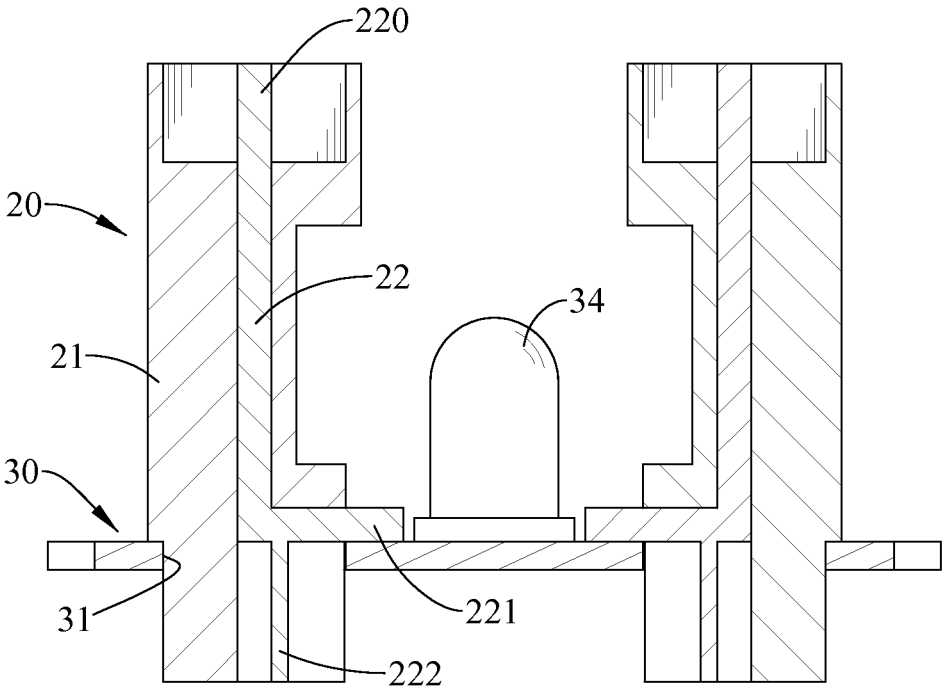
FIG. 4 is a vertical cross-sectional view showing the fixation posts mounted on a circuit board according to the first embodiment of the present invention.
Figure 5:
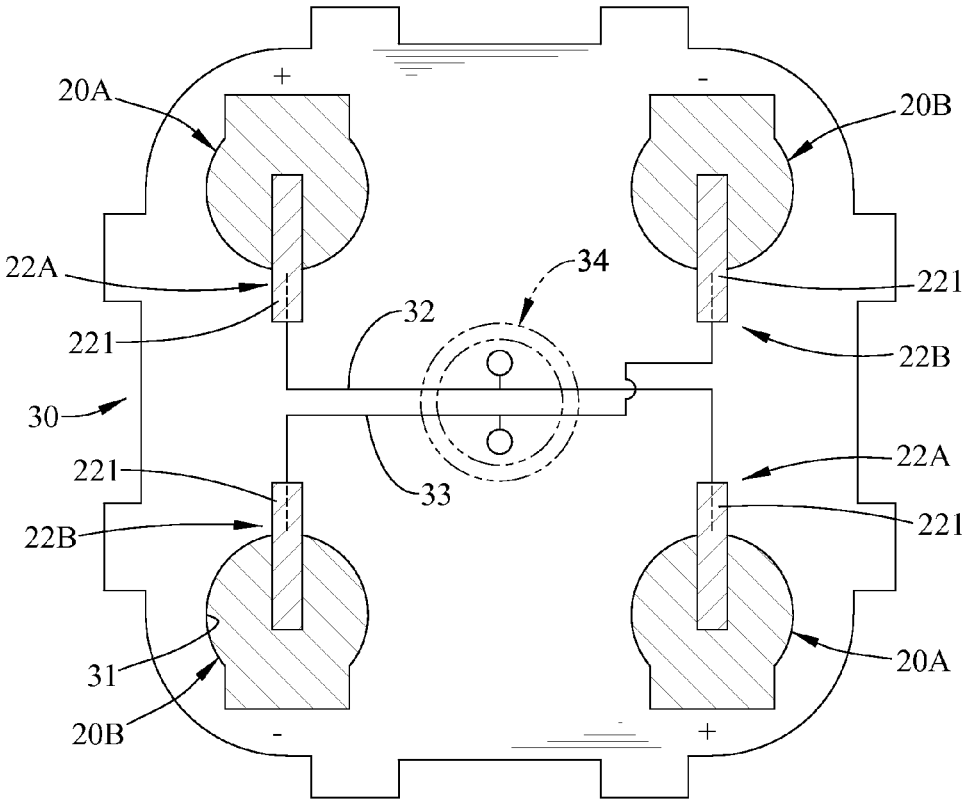
FIG. 5 is a horizontal cross-sectional view showing the fixation posts mounted on the circuit board according to the first embodiment of the present invention.

Referring to FIGS. 2, 4 and 5, the circuit board 30 is disposed in the interior of the brick 10. The circuit board 30 includes a plurality of insertion through holes 31 and the fixation posts 20 are respectively inserted through the insertion through holes 31. Furthermore, the circuit board 30 has a positive electrode circuit 32 and a negative electrode circuit 33 (as shown in FIG. 5). Each pair of fixation posts 20 has a first fixation post and a second fixation post. The contact electrode 221 of the conductive piece 22 of the first fixation post of each pair of fixation posts 20 is pressed against the circuit board 30, so that the contact electrode 221 of the first fixation post is contacted with and electrically connected with the positive electrode circuit 32. Due to being contacted with the positive electrode circuit 32, the first fixation post is defined as a positive electrode fixation post 20A and the conductive piece 22 of the positive electrode fixation post 20A is defined as a positive electrode conductive piece 22A. The contact electrode 221 of the conductive piece 22 of the second fixation post of each pair of fixation posts 20 is pressed against the circuit board 30, so that the contact electrode 221 of the second fixation post is contacted with and electrically connected with the negative electrode circuit 33. Due to being contacted with the negative electrode circuit 33, the second fixation post is defined as a negative electrode fixation post 20B and the conductive piece 22 of the negative electrode fixation post 20B is defined as a negative electrode conductive piece 22B. Preferably, the positive electrode fixation post 20A and the negative electrode fixation post 20B are symmetrically arranged in a matrix and crisscross with each other, such that both of the fixation posts immediately adjacent to two sides of the positive electrode fixation post 20A are the negative electrode fixation posts 20B and both of the fixation posts immediately adjacent to two sides of the negative electrode fixation post 20B are the positive electrode fixation posts 20A. Similarly, the positive electrode conductive pieces 22A and the negative electrode conductive pieces 22B are symmetrically arranged in a matrix and crisscross with each other.

The circuit board 30 further includes a functional unit 34 connected with the positive electrode circuit 32 and the negative electrode circuit 33. Preferably, the functional unit 34 is a LED light or a sound generating device.

Referring to FIG. 2, the base 40 is disposed in the interior of the brick 10. Moreover, the base 40 is located under the circuit board 30 and pressed against the bottom of the circuit board 30. The base 40 includes at least one pair of through holes 41 and the bottoms of the fixation posts 20 penetrate through the through holes 41 to pass through the base 40. Preferably, the base 40 is hollow out.

Referring to FIG. 6, when assembling two building blocks according to the first embodiment, the studs 11 of the lower brick 10 are inserted into the openings of the upper brick 10 and may be pressed against the base 40 of the upper brick 10. The bottom of the positive electrode fixation post 20A in the upper brick 10 is correspondingly inserted into the top of the positive electrode fixation post 20A in the lower brick 10 and the connection electrode 222 of the conductive piece 22 in the upper positive electrode fixation post 20A is contacted with the insertion electrode 220 of the conductive piece 22 in the lower positive electrode fixation post 20A, thereby electrically connecting the positive electrode fixation posts 20A in the upper and lower bricks 10 with each other. At this moment, the bottom of the negative electrode fixation post 20B in the upper brick 10 is correspondingly inserted into the top of the negative electrode fixation post 20B in the lower brick 10 and the connection electrode 222 of the conductive piece 22 in the upper negative electrode fixation post 20B is contacted with the insertion electrode 220 of the conductive piece 22 in the lower negative electrode fixation post 20B, thereby electrically connecting the negative electrode fixation posts 20B in the upper and lower bricks 10 with each other.

After the building blocks are connected with each other, the positive electrode fixation post 20A and the negative electrode fixation post 20B of the most top or the most bottom building block are respectively connected to a positive electrode and a negative electrode of a power supply, thereby supplying power to the functional unit 34 to emit light or generate sound.

Figure 7:
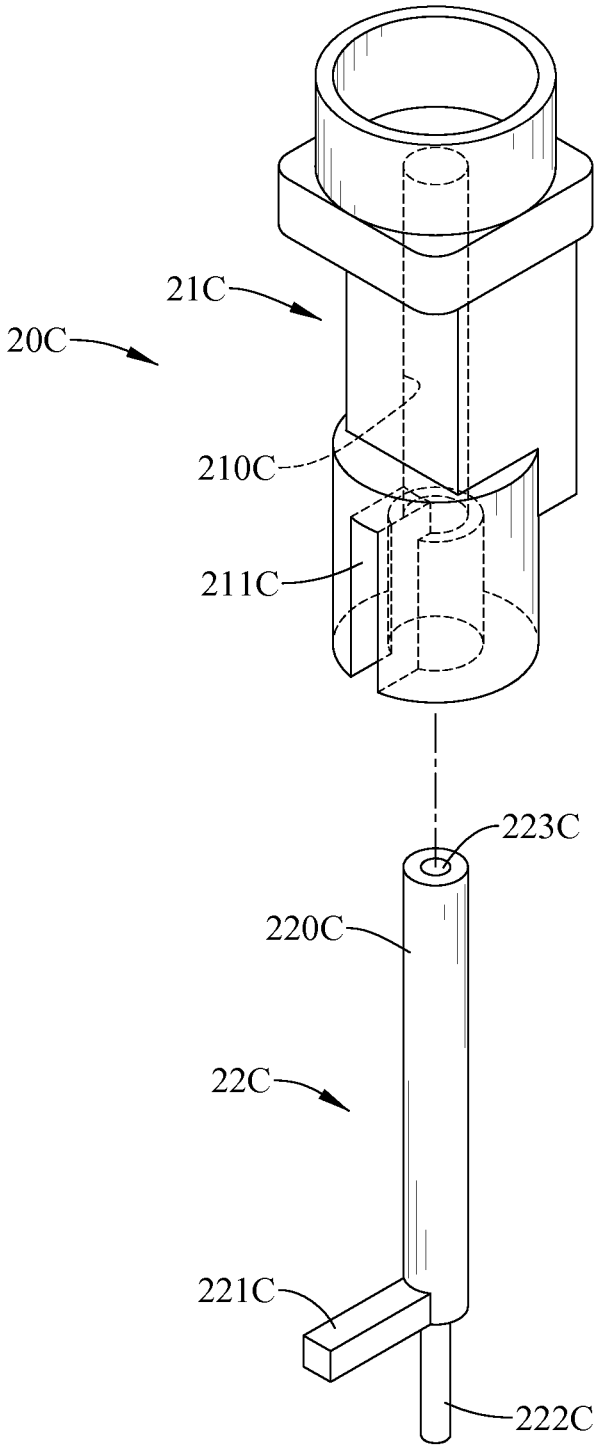
FIG. 7 is an exploded view showing a fixation post according to a second embodiment of the present invention.
Figure 8:
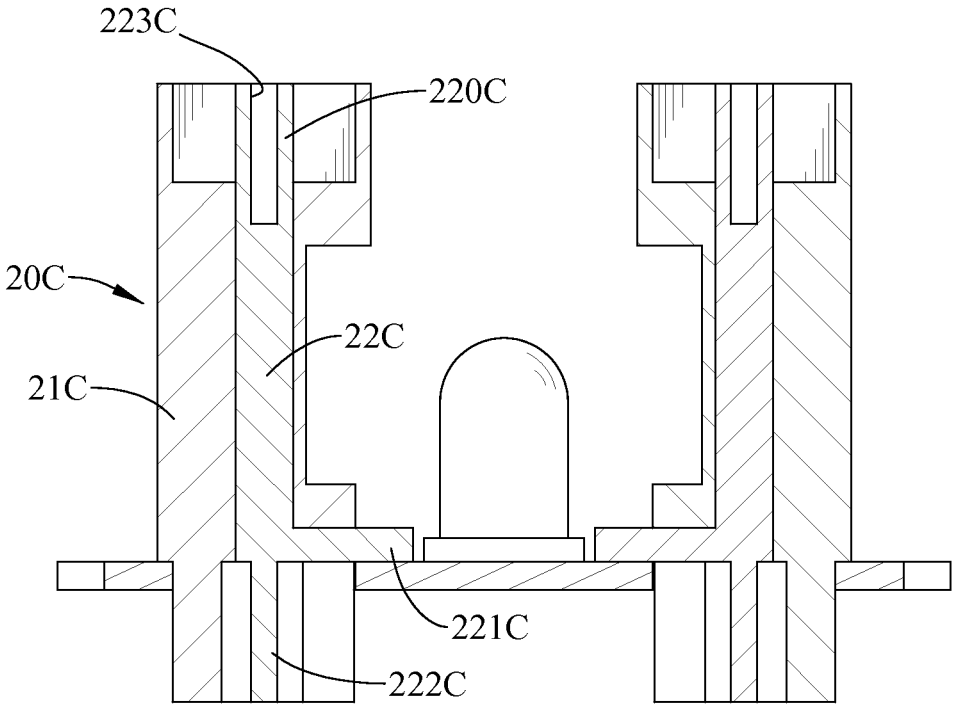
FIG. 8 is a vertical cross-sectional view showing the fixation posts mounted on the circuit board according to the second embodiment of the present invention.

A simplified modularized contact type of conductive building block according to a second embodiment of the present invention has a structure essentially the same as that of the first embodiment. However, the type of the fixation post 20C is slightly different from that of the first embodiment. Referring to FIGS. 7 and 8, a conductive piece 22C is disposed in an assembling hole 210C of the insulating piece 21C. An insertion electrode 220C is located at a top of the conductive piece 22C and projected out of the assembling hole 210C. A top end of the insertion electrode 220C is recessed to form an insertion hole 223C. A contact electrode 221C is horizontally extended from a side of a bottom of the conductive piece 22C. The contact electrode 221C penetrates through and projects out of the extension groove 211C. A connection electrode 222C is vertically extended from the bottom of the conductive piece 22C and located corresponding to the insertion hole 223C. The diameter of the connection electrode 222C is corresponding to the diameter of the insertion hole 223C.

Figure 9:
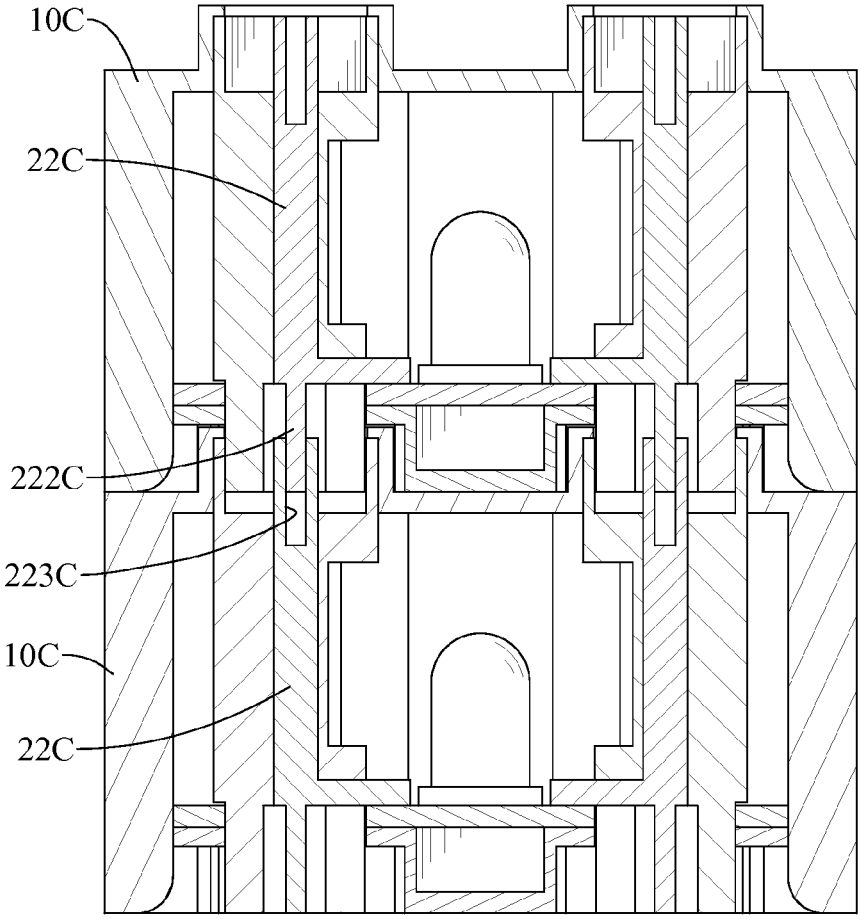
FIG. 9 is a cross-sectional view showing two of the simplified modularized contact type of conductive building blocks according to the second embodiment of the present invention connected with each other.

Referring to FIG. 9, when assembling two building blocks according to the second embodiment, the connection electrode 222C of the conductive piece 22C in the upper brick 10C is inserted into the insertion hole 223C of the conductive piece 22C in the lower brick 10C, thereby electrically connecting the conductive pieces 22C in the upper and lower bricks 10C with each other. Except the description mentioned above, the second embodiment has a structure, an assembling method and functions the same as that of the first embodiment. Thus, the descriptions about the structure, assembling method and functions of the second embodiment are not repeated again here.

Figure 10:
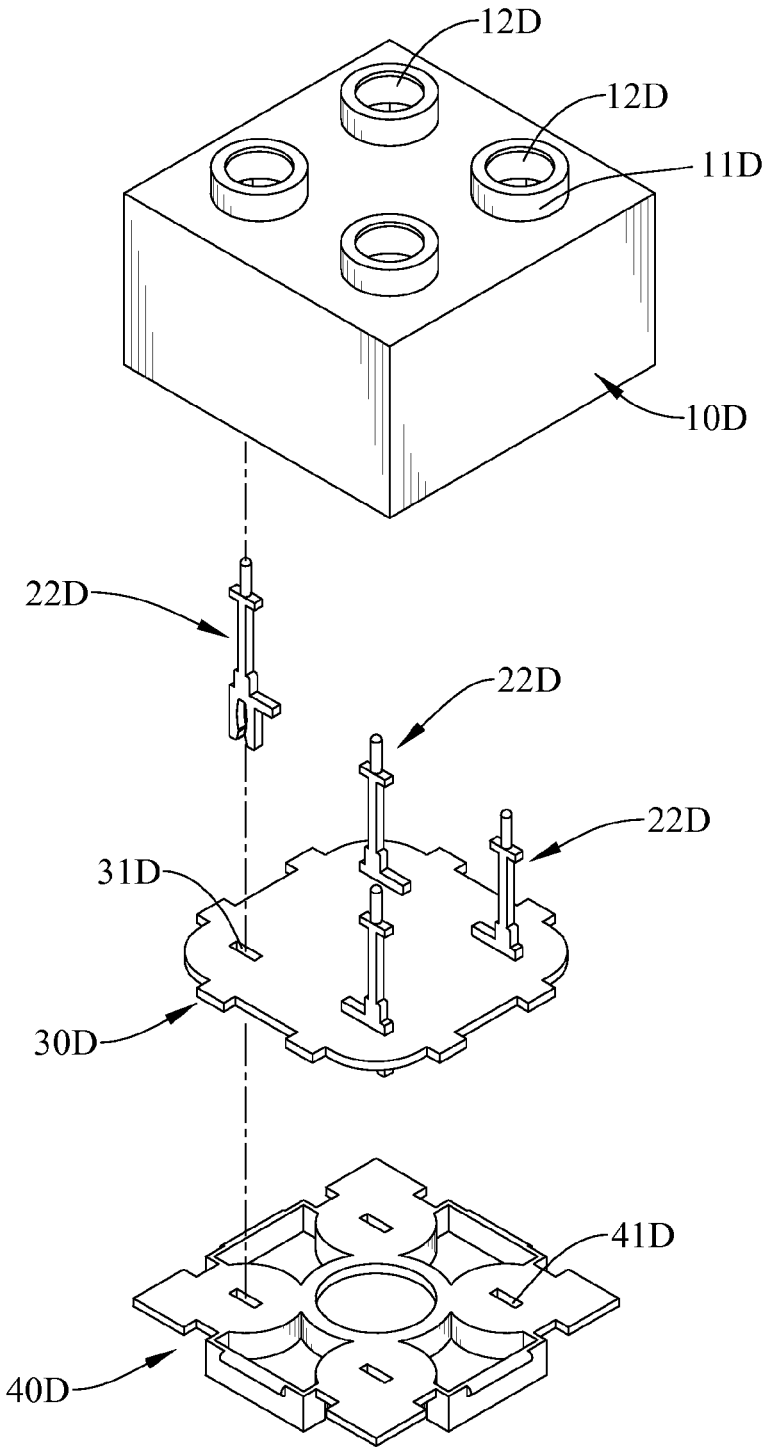
FIG. 10 is an exploded view showing a simplified modularized contact type of conductive building block according to a third embodiment of the present invention.
Figure 11:
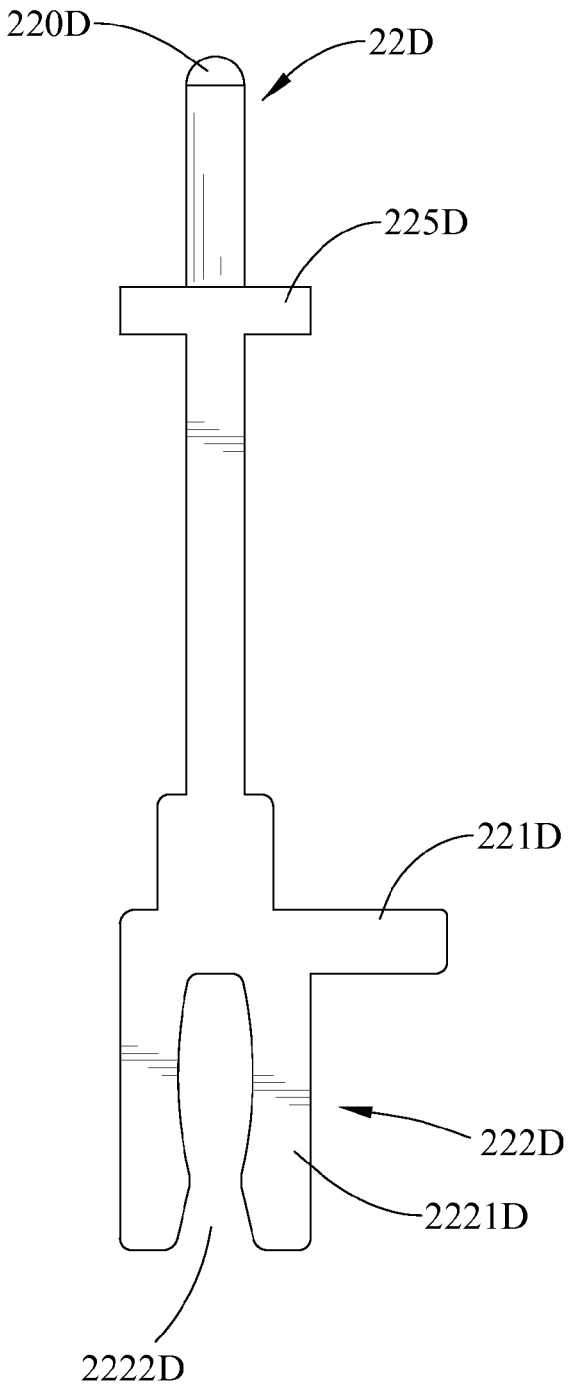
FIG. 11 is a side view showing a conductive piece according to the third embodiment of the present invention.
Figure 12:
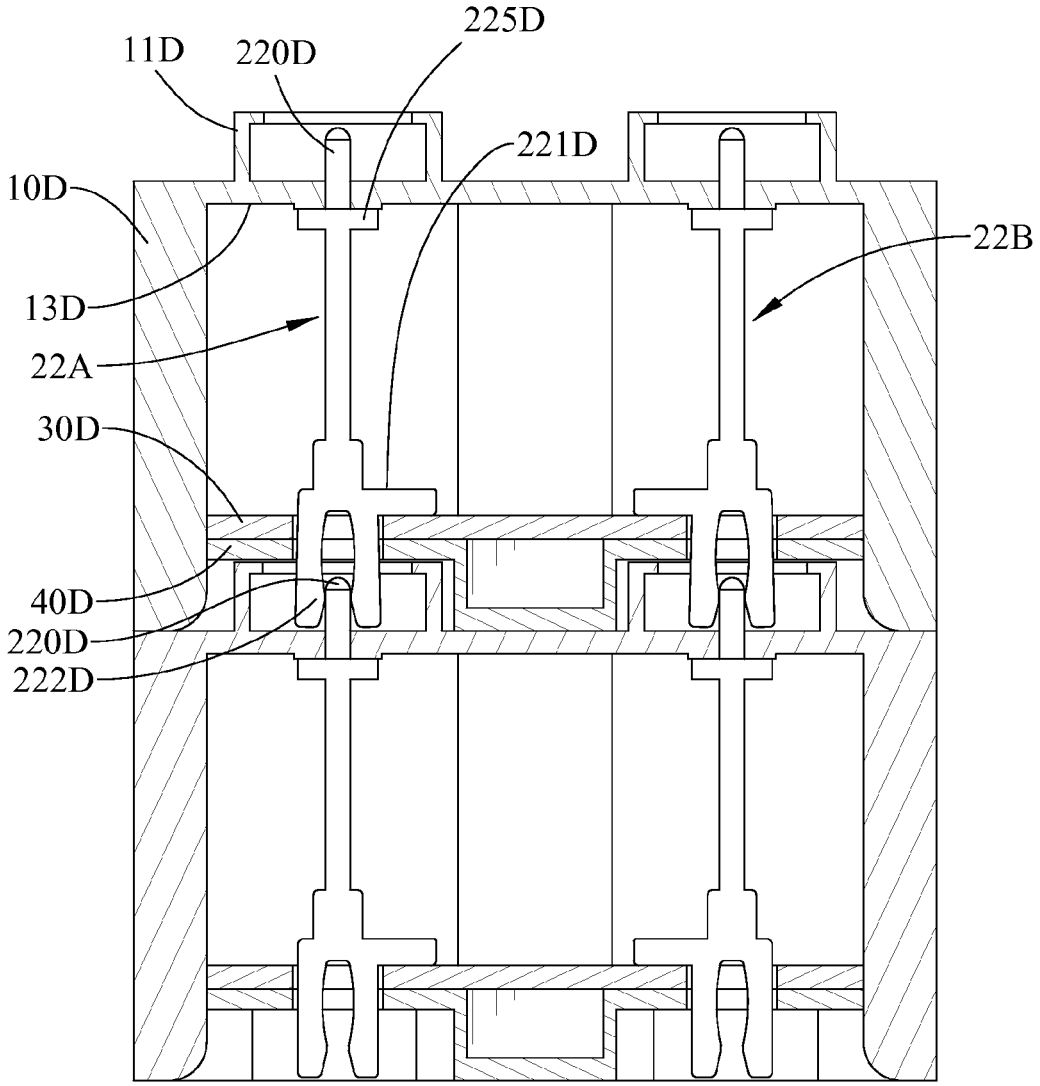
FIG. 12 is a cross-sectional view showing two of the simplified modularized contact type of conductive building blocks according to the third embodiment of the present invention connected with each other.

Referring to FIGS. 10 to 13, a simplified modularized contact type of conductive building block according to a third embodiment of the present invention has a structure similar to that of the first embodiment. The major difference between the first embodiment and the third embodiment is that the simplified modularized contact type of conductive building block according to the third embodiment only has a conductive piece 22D but does not have any insulating piece. Another difference between the two embodiments is that a retaining ridge 13D of the third embodiment is disposed at a different location from that of the retaining ridge 13 of the first embodiment. Referring to FIG. 11, the conductive piece 22D includes an insertion electrode 220D, a retaining portion 225D, a contact electrode 221D and a fork-shaped connection electrode 222D. The insertion electrode 220D is disposed at a top of the conductive piece 22D. The retaining portion 225D and the contact electrode 221D are disposed between the insertion electrode 220D and the connection electrode 222D. The retaining portion 225D is horizontally extended from the conductive piece 22D and located close to the insertion electrode 220D. The contact electrode 221D is horizontally extended from the conductive piece 22D and located close to the connection electrode 222D, so that the contact electrode 221D is perpendicular to the conductive piece 22D. The fork-shaped connection electrode 222D is located at the bottom of the conductive piece 22D and corresponding to the insertion electrode 220D. The fork-shaped connection electrode 222D according to the third embodiment includes two elastic end portions 2221D and a gap 2222D disposed between the two elastic end portions 2221D. The gap 2222D has a location and size corresponding to those of the insertion electrode 220D. The gap 2222D close to a bottom of the connection electrode 222D has a size smaller than that of the insertion electrode 220D. Referring to FIG. 12, each stud 11D according to the third embodiment includes a retaining ridge 13D corresponding to the conductive piece 22D and the retaining ridge 13D is extended from a bottom edge of the stud 11D. The locations and sizes of the retaining ridges 13D of the studs 11D are corresponding to those of the retaining portions 225D of the conductive pieces 22D.

Figure 13:
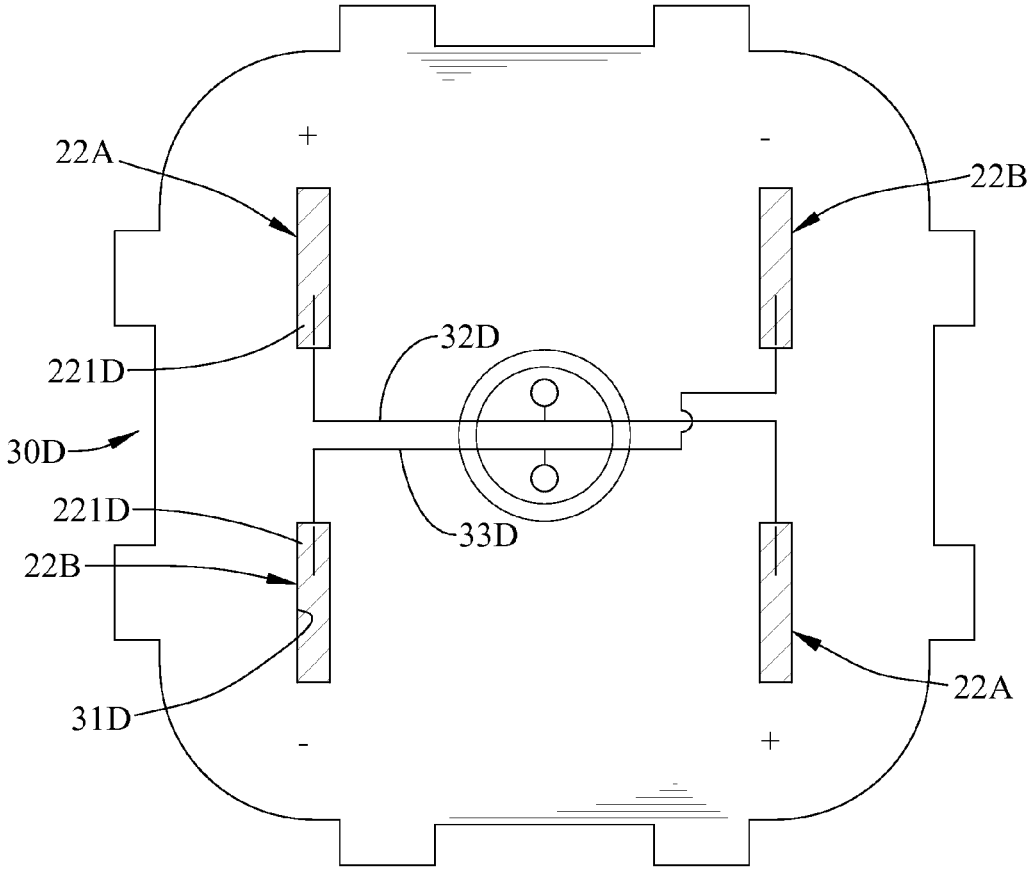
FIG. 13 is a horizontal cross-sectional view showing the conductive pieces mounted on a circuit board according to the third embodiment of the present invention.

Referring to FIGS. 10 and 12, when assembling the simplified modularized contact type of conductive building block according to the third embodiment, the conductive piece 22D is disposed in the brick 10D, the insertion electrode 220D of the conductive piece 22D is inserted through the retaining ridge 13D and received in the stud hole 12D, the retaining portion 225D of the conductive piece 22D is pressed against the retaining ridge 13D, the connection electrode 222D of the conductive piece 22D is inserted through the insertion through holes 31D of the circuit board 30D, the circuit board 30D is pressed against the contact electrode 221D of the conductive piece 22D, the connection electrode 222D of the conductive piece 22D is inserted through the through holes 41D of the base 40D, the base 40D is pressed against the circuit board 30D and the base 40D is then fixed in the brick 10D. Referring to FIG. 13, similar to the first embodiment, each pair of conductive pieces 22D has a first conductive piece and a second conductive piece. The contact electrode 221D of the first conductive piece of each pair of conductive pieces 22D is contacted with and electrically connected with the positive electrode circuit 32D; and the contact electrode 221D of the second conductive piece of each pair of conductive pieces 22D is contacted with and electrically connected with the negative electrode circuit 33D. Therefore, the first conductive piece of each pair of conductive pieces 22D is defined as a positive electrode conductive piece 22A; and the second conductive piece of each pair of conductive pieces 22D is defined as a negative electrode conductive piece 22B. Similar to the first embodiment, the positive electrode conductive pieces 22A and the negative electrode conductive pieces 22B according to the third embodiment are symmetrically arranged in a matrix and crisscross with each other.

Referring to FIGS. 11 and 12, when assembling two simplified modularized contact type of conductive building blocks according to the third embodiment, the insertion electrode 220D of the conductive piece 22D in the lower brick 10D is inserted into the corresponding gap 2222D of the connection electrode 222D of the conductive piece 22D in the upper brick 10D. Because the gap 2222D is aligned with the insertion electrode 220D and the gap 2222D close to a bottom of the connection electrode 222D has a size smaller than that of the insertion electrode 220D, the elastic end portions 2221D of the connection electrode 222D can securely hold the insertion electrode 220D of the conductive piece 22D. Therefore the conductive pieces 22D in the upper and lower bricks 10D are securely electrically connected with each other, which prevent the electric connection of the building blocks from getting loose. Except the description mentioned above, the third embodiment has a structure, an assembling method and functions the same as those of the first embodiment. Thus, the descriptions about the structure, assembling method and functions of the third embodiment are not repeated again here.

Figure 14:
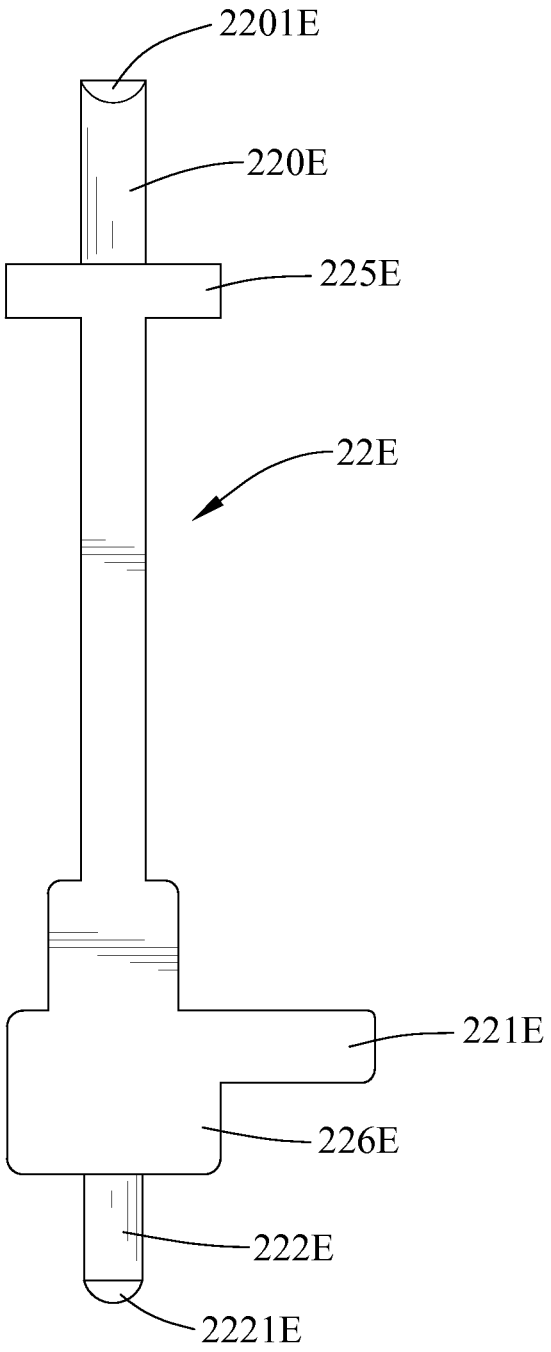
FIG. 14 is a side view showing a conductive piece according to a fourth embodiment of the present invention.
Figure 15:
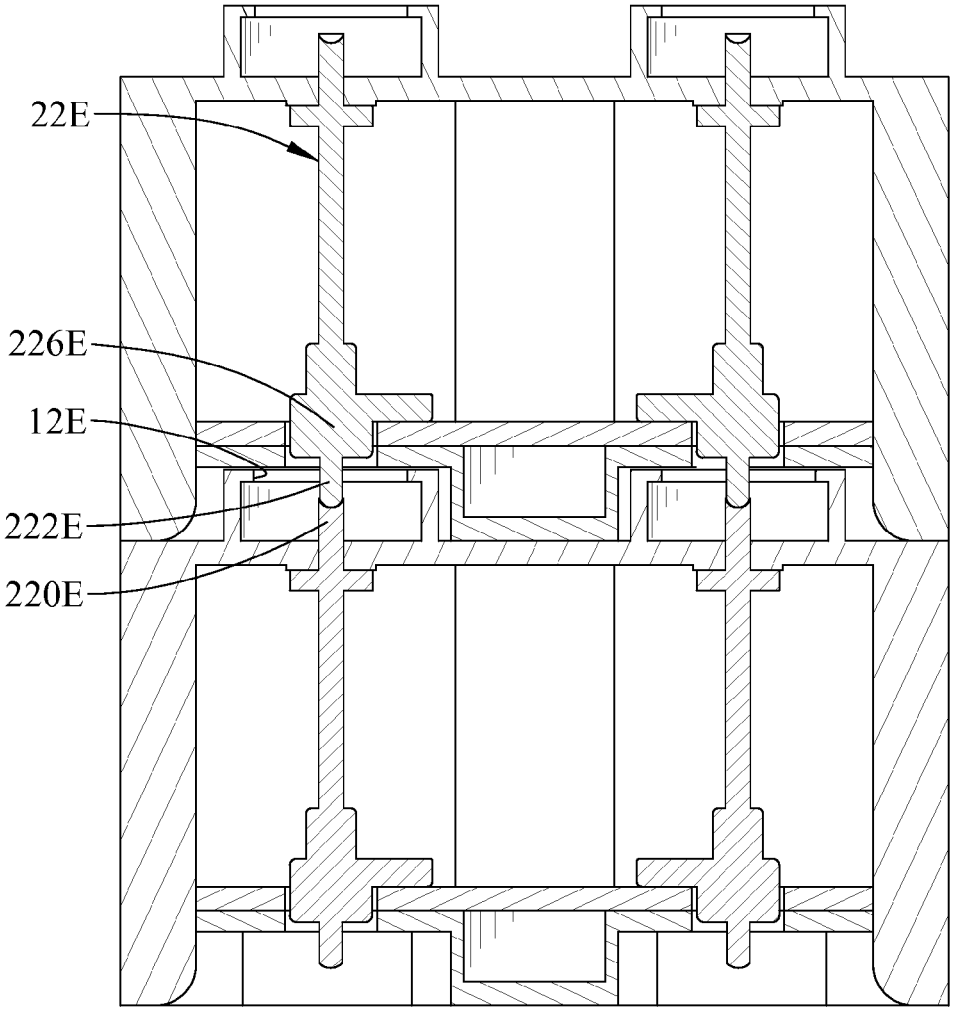
FIG. 15 is a cross-sectional view showing two of the simplified modularized contact type of conductive building blocks according to the fourth embodiment of the present invention connected with each other.

Referring to FIGS. 14 and 15, a simplified modularized contact type of conductive building block according to a fourth embodiment of the present invention has a structure similar to that of the third embodiment. The difference between the third embodiment and the fourth embodiment is that the simplified modularized contact type of conductive building block according to the fourth embodiment includes a conductive piece 22E having a configuration different from that of the conductive piece 22D of the third embodiment. The conductive piece 22E includes an insertion electrode 220E disposed at a top thereof and a connection electrode 222E disposed at a bottom thereof. The connection electrode 222E is aligned with the insertion electrode 220E. A top end of the insertion electrode 220E is recessed to form a curved cavity 2201E and a bottom end of the connection electrode 222E is protruded to form a curved protrusion 2221E corresponding to the curved cavity 2201E. Moreover, the conductive piece 22E includes a block 226E disposed adjacent to the contact electrode 221E. When the conductive piece 22E is assembled in the brick 10E, the block 226E is fitted in the insertion through hole 31E of the circuit board 30E and the through hole 41E of the base 40E. Therefore, the conductive piece 22E is more securely assembled with the circuit board 30E and the base 40E of the brick 10E.

When assembling two simplified modularized contact type of conductive building blocks according to the fourth embodiment, the connection electrode 222E of the conductive piece 22E in the upper brick 10E is received in stud hole 12E in the lower brick 10E. The curved protrusion 2221E of the connection electrode 222E in the upper brick 10E is contacted with the curved cavity 2201E of the insertion electrode 220E in the lower brick 10E, so that the conductive piece 22E in the upper brick 10E is electrically connected with the conductive piece 22E in the lower brick 10E.

Figure 16:
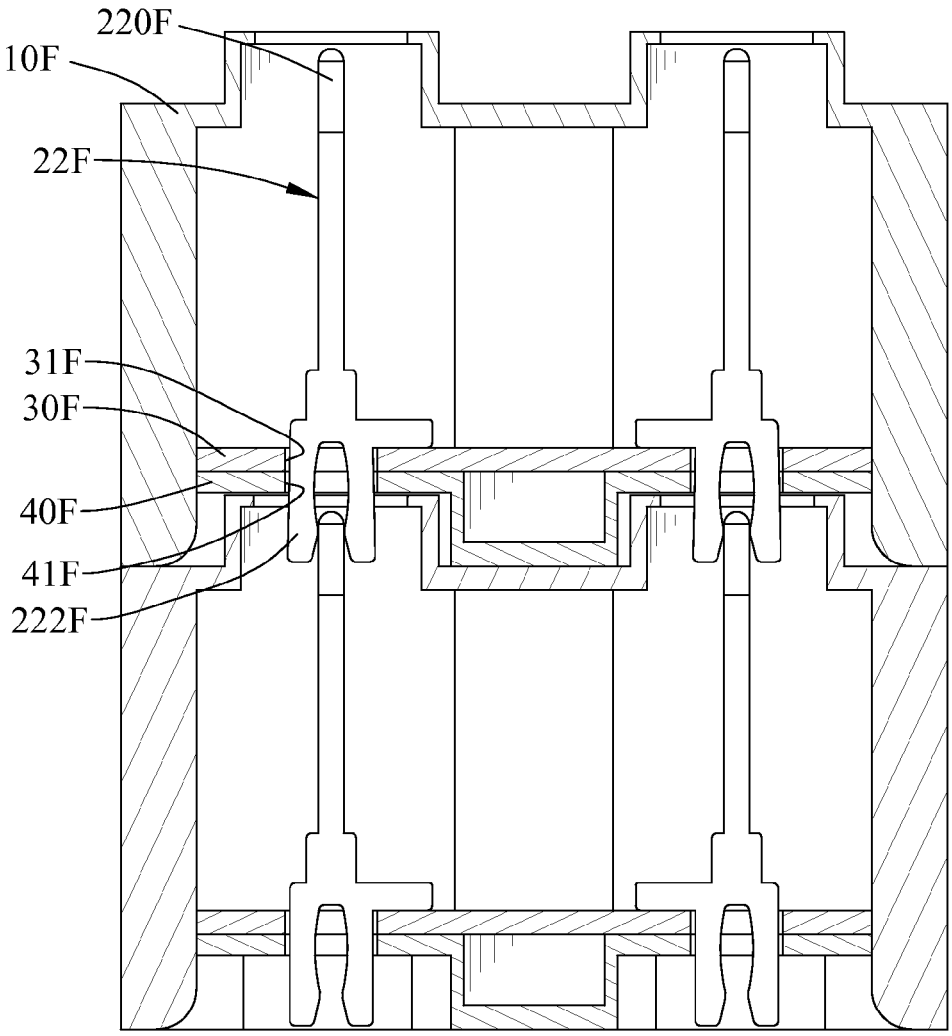
FIG. 16 is a cross-sectional view showing two simplified modularized contact type of conductive building blocks according to a fifth embodiment of the present invention connected with each other.

Referring to FIG. 16, a simplified modularized contact type of conductive building block according to a fifth embodiment of the present invention has a structure similar to that of the third embodiment. The differences between the two embodiments are that a conductive piece 22F of the fifth embodiment does not have the retaining portion 225D of the third embodiment and a brick 10F of the fifth embodiment does not have the retaining ridge 13D disposed at the bottom edge of the stud 11D of the third embodiment. When assembling the conductive piece 22F with the brick 10F, the connection electrode 222F of the conductive piece 22F is inserted through and fitted in the insertion through hole 31F of the circuit board 30F and the through hole 41F of the base 40F. Thus, the conductive piece 22F is securely assembled in the brick 10F by the circuit board 30F and the base 40F. When assembling two simplified modularized contact type of conductive building blocks according to the fifth embodiment, the insertion electrode 220F of the conductive piece 22F in the lower brick 10F is held by the connection electrode 222F of the conductive piece 22F in the upper brick 10F. Therefore, the conductive pieces 22F in the upper and lower bricks 10F are electrically connected with each other.

Figure 17:
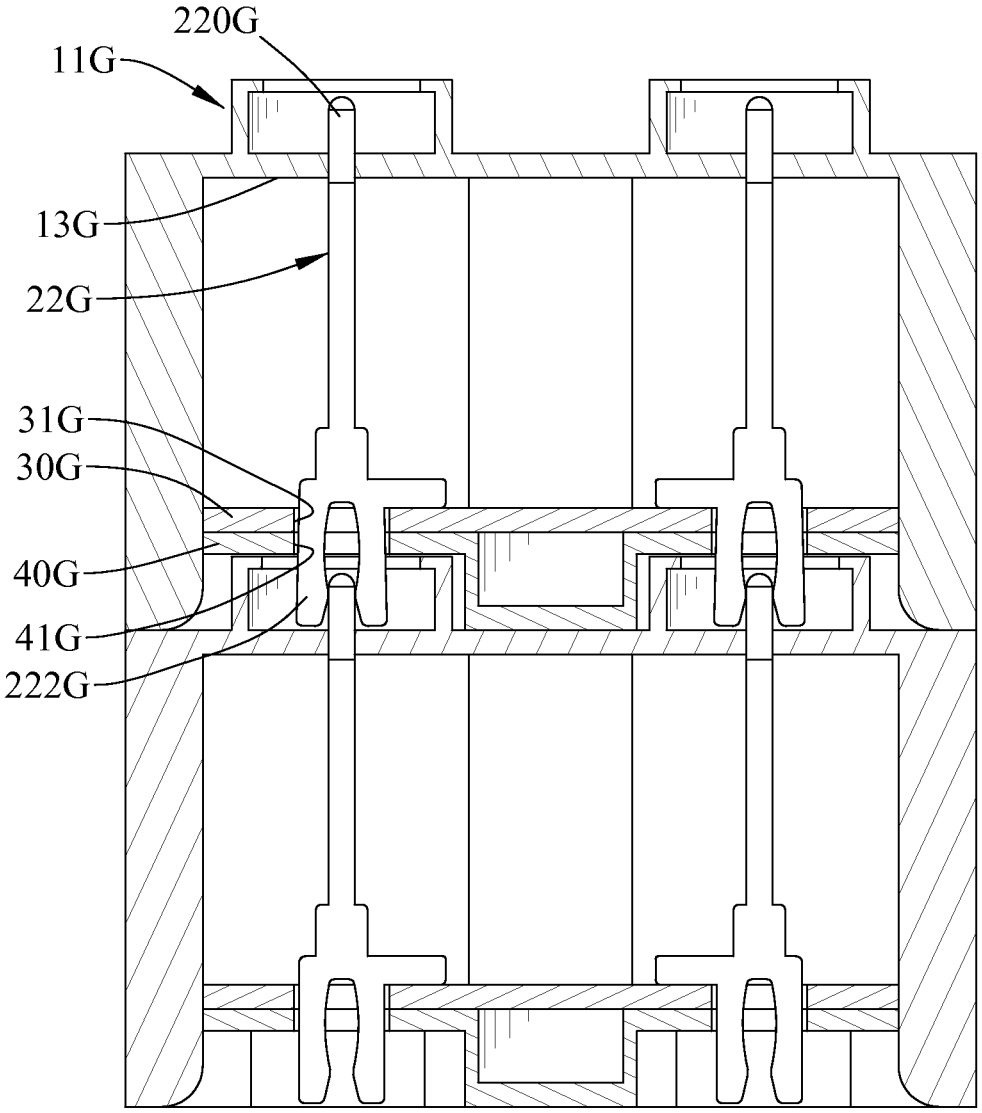
FIG. 17 is a cross-sectional view showing two simplified modularized contact type of conductive building blocks according to a sixth embodiment of the present invention connected with each other.

Referring to FIG. 17, a simplified modularized contact type of conductive building block according to a sixth embodiment of the present invention has a structure similar to that of the third embodiment. The major difference between the two embodiments is that a conductive piece 22G of the sixth embodiment does not have the retaining portion 225D of the third embodiment. When assembling the conductive piece 22G with the brick 10, the insertion electrode 220G is inserted through and held by the retaining ridge 13G of the stud 11G and the connection electrode 222G is inserted through the insertion through hole 31G of the circuit board 30G and the through hole 41G of the base 40G. When assembling two simplified modularized contact type of conductive building blocks according to the sixth embodiment, the insertion electrode 220G of the conductive piece 22G in the lower brick 10G is held by the connection electrode 222G of the conductive piece 22G in the upper brick 10G. Therefore, the conductive pieces 22G in the upper and lower bricks 10G are electrically connected with each other.

Figure 18:
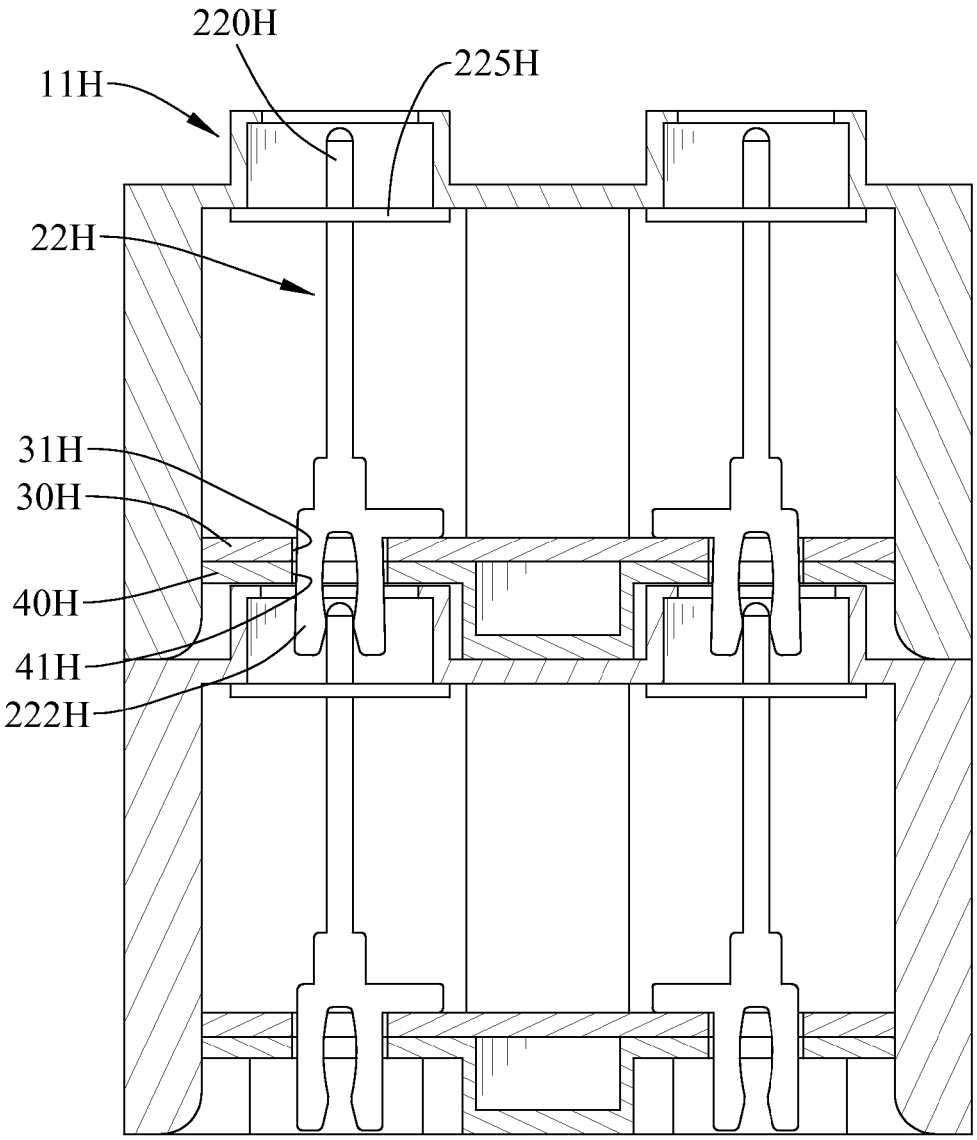
FIG. 18 is a cross-sectional view showing two simplified modularized contact type of conductive building blocks according to a seventh embodiment of the present invention connected with each other.

Referring to FIG. 18, a simplified modularized contact type of conductive building block according to a seventh embodiment of the present invention has a structure similar to that of the third embodiment. The differences between the two embodiments are that a brick 10H of the seventh embodiment does not have the retaining ridges 13D disposed at the bottom edge of the stud hole 12D of the third embodiment and a retaining portion 225H of a conductive piece 22H of the seventh embodiment has a size corresponding to that of a stud 11H. When assembling the conductive piece 22H with the brick 10H, the retaining portion 225H of the conductive piece 22H is directly pressed against the bottom edge of the stud 11H and the connection electrode 222H of the conductive piece 22H is inserted through the insertion through hole 31H of the circuit board 30H and the through hole 41H of the base 40H. When assembling two simplified modularized contact type of conductive building blocks according to the seventh embodiment, the insertion electrode 220H of the conductive piece 22H in the lower brick 10H is held by the connection electrode 222H of the conductive piece 22H in the upper brick 10H. Therefore, the conductive pieces 22H in the upper and lower bricks 10H are electrically connected with each other.

Figure 19:
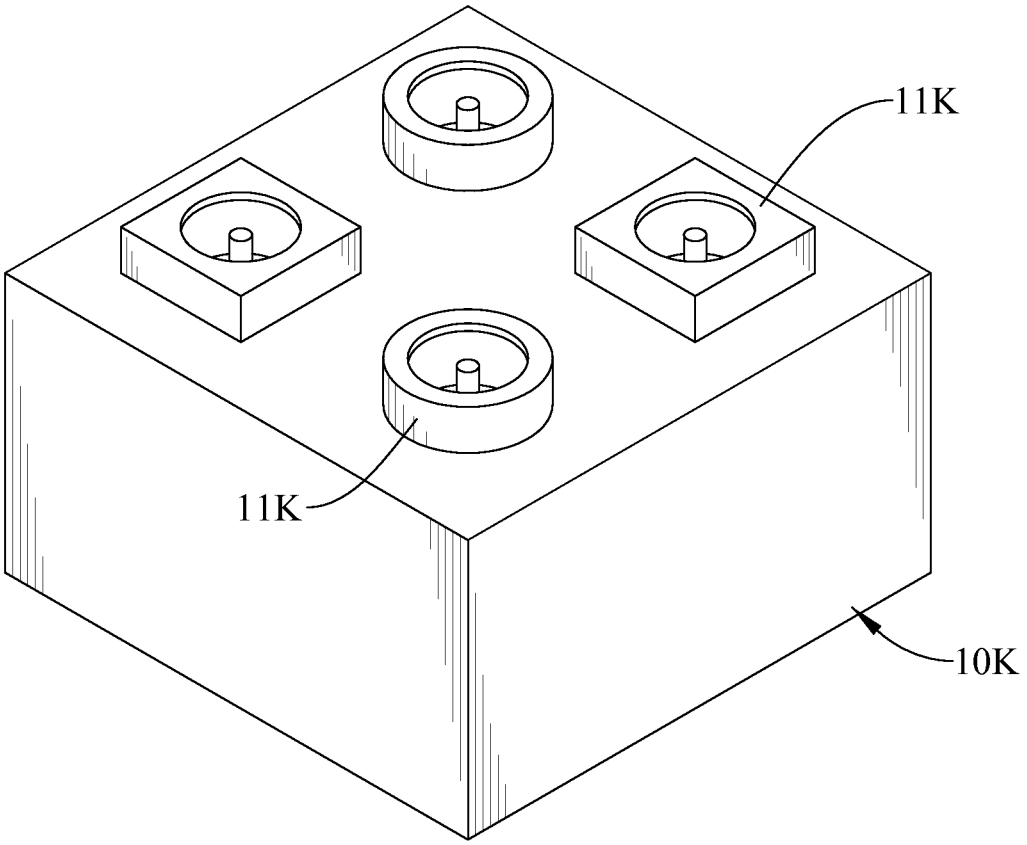
FIG. 19 is a perspective view showing a simplified modularized contact type of conductive building block according to an eighth embodiment of the present invention.

Referring to FIG. 19, a simplified modularized contact type of conductive building block according to an eighth embodiment has a structure essentially the same as that of the first embodiment. Nevertheless, a first stud of the at least one pair of studs 11K of the brick 10K is shaped in a circle and a second stud 11K is shaped in a rectangle. When the brick 10K has a plurality pairs of studs 11K, the circular and rectangular studs 11K are symmetrically arranged in a matrix and crisscross with each other, such that both studs 11K immediately adjacent to two sides of the circular stud 11K are the rectangular studs and both studs 11K immediately adjacent to two sides of the rectangular stud are the circular studs 11K. Except the description mentioned above, the eighth embodiment has a structure, an assembling method and functions the same as that of the first embodiment. Thus, the descriptions about the structure, assembling method and functions of the eighth embodiment are not repeated again here.

It is easy to distinguish locations of the positive and negative electrode conductive pieces from the appearances of the studs 11K according to the eighth embodiment. Therefore, the building block according to the eighth embodiment is equipped with a fool-proofing function when assembling. For example, the positive electrode conductive piece is received in a circular stud 11K and the negative electrode conductive piece is received in a rectangular stud 11K. When connecting the building blocks together, the user can easily and accurately connect the positive electrode conductive pieces with each other and connect the negative electrode conductive pieces with each other. It can prevent from misconnecting the positive electrode conductive piece with the negative electrode conductive piece.

No matter it is the positive electrode conductive piece 22A or the negative electrode conductive piece 22B, the simplified modularized contact type of conductive building block according to the present invention provides the positive and negative electrode conductive pieces having the same structure. The conductive pieces have simple structures and are easy to assemble, so the complex designs of conventional building blocks are significantly simplified and the manufacturing cost is greatly reduced.

Furthermore, the positive and negative electrodes are decided by the contact electrode 221 of the conductive piece 22 being contacted with the positive electrode circuit 32 or the negative electrode circuit 33 of the circuit board 30. Therefore, when the contact electrode 221 is contacted with the positive electrode circuit 32, the conductive piece 22 is the positive electrode. And, when the contact electrode 221 is contacted with the negative electrode circuit 33, the conductive piece 22 is the negative electrode. The structure of the conductive piece 22 served as the positive electrode is the same as that of the conductive piece 22 served as the negative electrode. Therefore, different from the conventional building blocks having to provide two different elements for the positive and negative electrodes, the present invention only need to provide a single element that can serve as both of the positive electrode and the negative electrode. Moreover, each stud hole of the conventional building blocks has both of the positive and negative electrodes simultaneously disposed therein. On the contrary, each stud hole 12 according to the present invention has only one single electrode disposed therein. Thus, it does not need to worry about the metal foreign matter fallen into the stud hole 12 or the studs being compressed and deformed, which causes the positive and negative electrodes contacted with each other and short circuit. Therefore, the safety of the building blocks is increased.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A simplified modularized contact type of conductive building block, comprising:

A hollow brick having at least one pair of studs projected from a top thereof and an opening defined in a bottom thereof and communicating with an interior thereof, a stud hole penetrating through each stud and communicating with the interior of the brick;

at least one pair of conductive pieces corresponding to the at least one pair of studs and respectively disposed in the stud holes, each conductive piece including an insertion electrode extended from a top thereof, a connection electrode extended from a bottom thereof and a contact electrode disposed between the insertion electrode and the connection electrode and horizontally extended from the conductive piece;

a circuit board disposed in the brick, the circuit board including at least one pair of insertion through holes corresponding to the at least one pair of the conductive pieces, the connection electrodes of the conductive pieces being inserted through the corresponding insertion through holes, the circuit board including a positive electrode circuit and a negative electrode circuit, the positive electrode circuit contacted with the contact electrode of a first conductive piece of each pair of conductive pieces and the first conductive piece being defined as a positive electrode conductive piece, the negative electrode circuit contacted with the contact electrode of a second conductive piece of each pair of conductive pieces and the second conductive piece being defined as a negative electrode conductive piece; and a base disposed in the brick, the base including at least one pair of through holes corresponding to the at least one pair of the conductive pieces, the connection electrodes of the conductive pieces being inserted through the corresponding through holes.

2. The building block as claimed in claim 1, wherein the contact electrode is perpendicular to the conductive piece.

3. The building block as claimed in claim 1, wherein the connection electrode of the conductive piece includes two end portions and a gap disposed between the two end portions, and the insertion electrode of the conductive piece is corresponding to the gap of the connection electrode.

4. The building block as claimed in claim 3, wherein the gap of the connection electrode has a size corresponding to that of the insertion electrode of the conductive piece.

5. The building block as claimed in claim 3, wherein the gap close to an end of the connection electrode has a size smaller than that of the insertion electrode of the conductive piece.

6. The building block as claimed in claim 1, wherein the insertion electrode is aligned with the connection electrode, the insertion electrode includes a curved cavity and the connection electrode includes a curved protrusion corresponding to the curved cavity of the insertion electrode.

7. The building block as claimed in claim 1, wherein the conductive piece includes a retaining portion disposed between the insertion electrode and the connection electrode, located adjacent to the insertion electrode, and horizontally extended from the conductive piece to be pressed against a bottom edge of the stud.

8. The building block as claimed in claim 1, wherein a bottom edge of the stud is extended inward to form a retaining ridge, the insertion electrode of the conductive piece is inserted through the retaining ridge of the stud.

9. The building block as claimed in claim 8, wherein the conductive piece includes a retaining portion disposed between the insertion electrode and the connection electrode, the retaining portion is horizontally extended from the conductive piece to be pressed against the retaining ridge of the stud.

* * * * *